US005935088A

United States Patent [19]

Bosley

[11] Patent Number: 5,935,088

[45] Date of Patent: Aug. 10, 1999

[54] MASSAGING APPARATUS WITH VACUUM, AUXILIARY POWER SOURCE AND PINCH ROLLERS

[76] Inventor: Marguerite Bosley, 221 Martin Dr., Wylie, Tex. 75098

[21] Appl. No.: 08/925,468

[22] Filed: Sep. 8, 1997

[51] Int. Cl.[6] ..... A61H 7/00

[52] U.S. Cl. ..... 601/7; 601/123; 601/125; 601/126; 601/133; 604/315; 15/344; 15/384; 15/389

[58] Field of Search ..... 601/6–12, 122, 601/123, 133, 125–7; 604/315; 15/344, 384, 389, 391

[56] References Cited

U.S. PATENT DOCUMENTS 1,651,585 12/1927 Clair .
2,218,443 10/1940 Tweddle ..... 128/297
4,419,784 12/1983 Lex ..... 15/344
4,729,368 3/1988 Guitay ..... 128/57
5,665,053 9/1997 Jacobs ..... 601/2

FOREIGN PATENT DOCUMENTS 738479 10/1955 Switzerland ..... 15/344

*Primary Examiner*—Danton D. DeMille
*Attorney, Agent, or Firm*—Martin Sachs, Esq.

[57] ABSTRACT

A massaging apparatus includes a hollow housing having a centrally disposed hollow chamber with an opening at the bottom out of which extends two power driven rollers. A handle is provided on the housing in addition to a hollow extending portion communicating with the central chamber for connection to a vacuum source. A flywheel motor disposed within the hollow chamber is coupled to an auxiliary power source disposed within the hollow housing. A centrifugal squirrel cage fan is disposed on the motor shaft at one end with a driving pulley on the other end of the motor shaft that is coupled to the pair of elongated rollers.

8 Claims, 1 Drawing Sheet

MASSAGING APPARATUS WITH VACUUM, AUXILIARY POWER SOURCE AND PINCH ROLLERS

BACKGROUND OF THE INVENTION

1. Field of the Invention

The present invention relates to portable massaging devices, and more particularly, to a portable lightweight apparatus for massaging the human body.

2. Background of the Invention

There are numerous types of devices used for massaging the human body in order to relieve pain and relax the muscles. Some of these devices utilize manipulations, which exercise pressure or displacements of the epidermis, such as pinching, or may provide electrical pulses to stimulate circulation. Generally this equipment is used by professionals and is expensive. Techniques which utilize massaging have been successful in reducing and treating of cutaneous, cellulitic and dermalgic zones utilizing a "rolled palpation" technique.

The present invention overcomes shortcomings found in the prior art by providing a simple, inexpensive means of providing the palpation or pinching technique, which may be utilized by an individual on his or her own body.

Typical of these devices is disclosed in U.S. Pat. No. 4,729,368 issued to Guitay on Mar. 8, 1988. This device is an industrial apparatus suitable for use in a professional's office and is not portable nor suitable for an individual to use on his or her own body. Another device is disclosed in U.S. Pat. No. 4,883,047 issued to Guitay on Nov. 28, 1989, which is an attempt to utilize a portable hand held apparatus for massaging parts of the human body that is over simplified and does not provide power to the massaging rollers.

SUMMARY OF THE INVENTION

Therefore, it is an object of the present invention to provide a portable hand held apparatus suitable for massaging the human body.

It is another object of the present invention to provide a portable hand held massaging apparatus used in combination with a vacuum source and auxiliary power to provide a pinching motion during the massaging process.

It is yet another object of the present invention which is suitable for massaging the human body that is connected to a conventional vacuum source and has the option of providing additional power to the massage roller by an auxiliary power source.

A massaging apparatus, according to the principles of the present invention, includes a hollow housing having a centrally disposed hollow chamber with an opening at the bottom, an outwardly extending handle that is disposed transverse to the opening. A hollow extending portion is disposed proximate the outwardly extending handle communicates with the hollow central chamber of the housing and is adapted to be removably affixed to a vacuum generating source. A control device provides for the application of auxiliary power, which is disposed within the hollow chamber, and is coupled to said control means. A flywheel motor is disposed within said hollow chamber and is coupled to the source of auxiliary power and has an output shaft extending outwardly therefrom transverse to the outwardly extending handle. The output shaft has a centrifugal squirrel cage fan disposed thereon at one end and a pulley drive wheel on the other end. A pair of elongated rollers are positioned parallel to motor shaft with a portion of each the rollers extending beyond the housing bottom opening. The rollers are provided with drive wheels that are coupled to the pulley drive wheel.

The foregoing and other objects and advantages will appear in the description that follows. In the description reference is made to the accompanying drawing, which forms a part hereof, and in which is shown by way of illustration a specific embodiment in which the invention may be practiced. This embodiment will be described in sufficient detail to enable those skilled in the art to practice the invention and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described by way of example, with reference to the accompanying drawing in which.

DESCRIPTION OF THE PREFERRED EMBODIMENT

Figure 1:
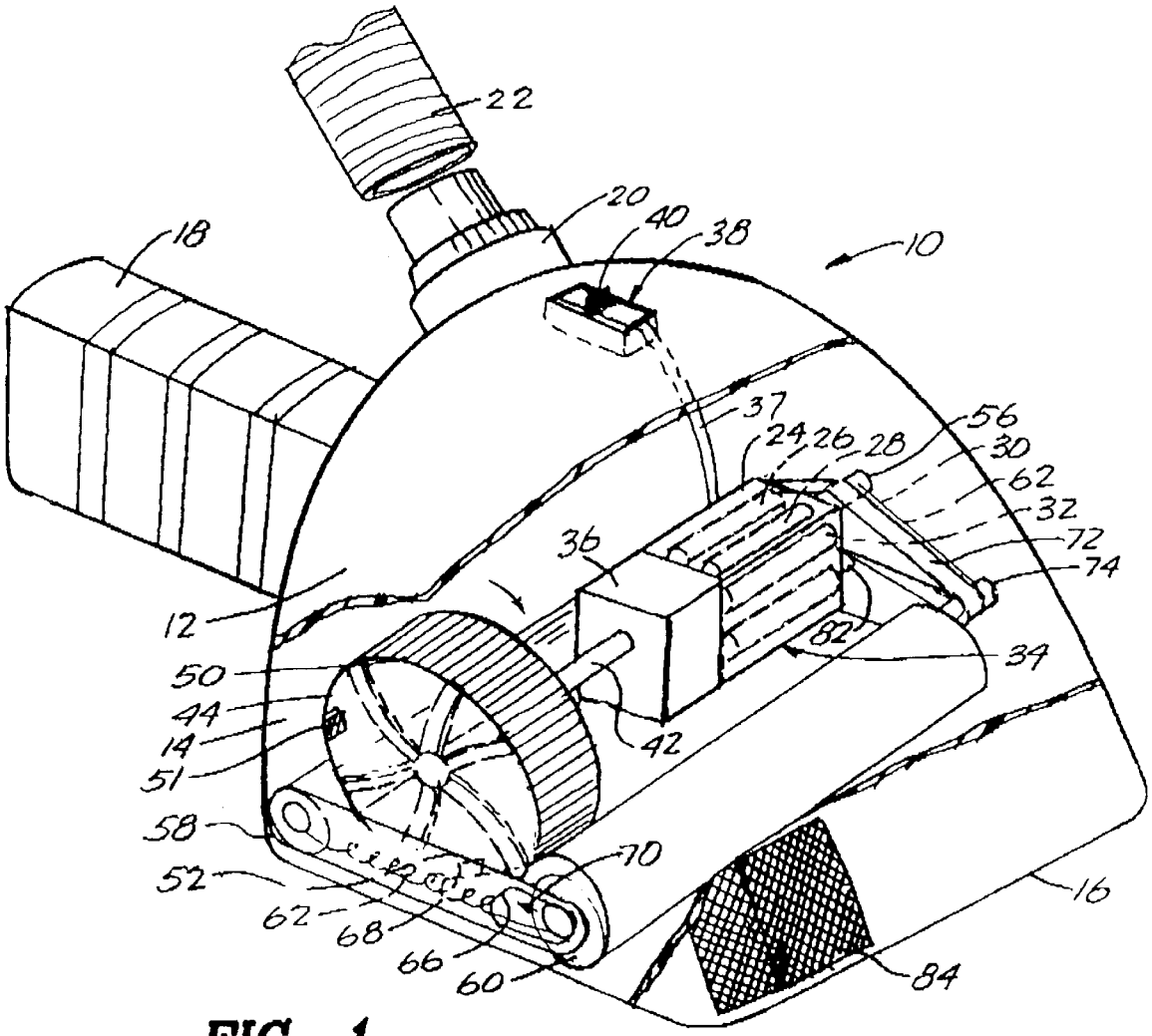
FIG. 1 is a prospective drawing, partially broken away, showing the principle components of a massaging apparatus, according to the principles of the sent invention.

Referring now to the figures and in particular to FIG. 1, there is shown a hand held massaging apparatus 10, according to the principles of the present invention. The apparatus 10 is seen to include a hollow housing 12 having a centrally disposed hollow chamber 14 and an opening 16 at the bottom of the housing 12. A handle 18 is provided on the housing 12 disposed transverse to the opening 16. In addition, proximate the handle 18, a hollow extending portion 20 that communicates with the hollow chamber 14 of the housing 12 is provided. The extending portion 20 is adapted to the coupled by means of a flexible hose 22 to a vacuum source, not shown, such as a conventional vacuum cleaner. Disposed within the hollow chamber 14 of the housing 12 is an auxiliary power source 24, which includes a plurality of batteries 26, 28, 30, 32 disposed within a housing 34, that has a flywheel motor 36 affixed thereon. The auxiliary power source 24 is coupled by means by cable 37 through a control device 38 that is operated by a switch 40 capable of providing intermittent power to the flywheel motor 36 as needed.

The flywheel motor 36 is provided with one output shaft 42 that has a centrifugal squirrel cage fan 44 disposed thereon. The squirrel cage fan 44 is provided with a plurality of small weights 50, 51 and 52 which tend to keep the fan 44 and motor 36 running once energy has been supplied to the fan 44 as will be explained hereinafter. A second output shaft 54 (see FIG. 2) is provided at the other end of the flywheel motor 36, which has a drive pulley 56 affixed thereon. Output shafts 42 and 54 are positioned transverse to the outwardly extending handle 18 of the housing 12.

Figure 2:
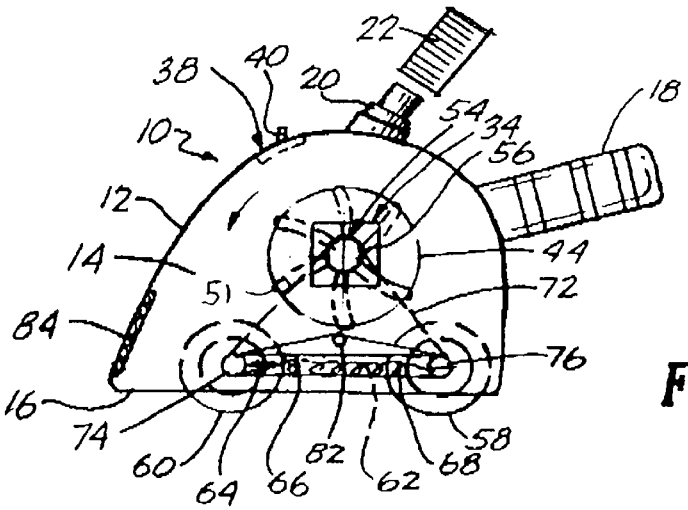
FIG. 2 is an end view in elevational, with the housing wall removed showing the position of the components of the apparatus shown in FIG. 1.

A pair of elongated rollers 58 and 60 are positioned parallel to the shafts 42 and 54 and protrude from the bottom opening 16 of the housing 12. The roller 58 is fixed in position with regard to the handle 18, while the roller 60 is urged away from the handle 18 by means of a spring 62 and is permitted to move in the direction of arrows 64 within an elongated aperture or slot 66 provided in a link 68 so that the rollers 58 and 60 are urged apart until they are placed upon a human body and moved across the skin of the person, wherein the roller 60 would move in the direction of arrow 70. The exact same linkage arrangement and movement of the rollers 58 and 60 is found on the opposite end of the rollers 58 and 60, as shown in FIG. 2. The flywheel pulley 56, as shown in FIG. 2, is coupled by means of a flexible belt 72 to the roller drive pulleys 74 and 76 to provide rotation of the rollers 58 and 60. The flexible belt 72 is also placed over an idler pulley 82 (see FIG. 2) to keep the flexible belt 72 taut when the roller 60 moves within slot or aperture 66 of the link 68.

The housing 12 is also provided with a screened opening 84, which permits the outside air to flow over the squirrel cage fan 44, when the vacuum supply is connected, via the hose 22, to the extending portion 20 of the housing 12, thereby supplying energy to the fan 44 and the flywheel motor 36.

In operation, the vacuum hose 22 is attached to the extending portion 20 of the housing 12 and turned "ON", causing air flow, via the screen 84, that flows over the squirrel cage fan 44 setting it in motion and it would tend to stay in motion because of the weights 50, 51 and 52 placed about the circumference of the squirrel cage fan 44, thereby supplying energy to the flywheel motor 36, which would increase, once the bottom opening 16 of the housing 12 is placed against a person's skin. Repeated movements of the housing 12 with pressure applied to a person's skin causes the springs 62 to move the rollers in a squeezing or pinching motion. Intermittent energy, in addition to that caused by the air flow, is supplied by the auxiliary power source 24, which is activated by the switch 40, as needed, to supply additional power to increase the pinching force on the rollers when applied to the person's skin.

Hereinbefore has been disclosed a relatively lightweight and portable massaging apparatus suitable for use by an individual on his or her own body. It will be understood that various changes of the details, materials, arrangement of parts and operating conditions that have been herein described and illustrated in order to describe the nature of the invention made by made by those skilled in the art within the principles and scope of the present invention.

Having thus set forth the nature of the invention, what is claimed is:

1. A massaging apparatus comprising:

A. a hollow housing having;

a) a centrally disposed hollow chamber, b) an opening at the bottom, c) an outwardly extending handle means suitable for being held in a persons hand, disposed transverse to said opening, d) a hollow extending portion disposed proximate said outwardly extending handle means communicating with the hollow central chamber of said housing, said hollow extending portion adapted to be removably affixed to a vacuum generating source, and e) control means for controlling the application of auxiliary power;

B. auxiliary power means disposed within said hollow chamber coupled to said control means;

C. flywheel motor means disposed within said hollow chamber coupled to said source of auxiliary power, said flywheel motor means having, a) an output shaft extending outwardly from said motor means transverse to said outwardly extending handle means, said output shaft having, i) a centrifugal squirrel cage fan disposed thereon at one end, and ii) a pulley drive wheel disposed on the other end;

D. a pair of elongated rollers disposed parallel to said motor means shaft with a portion of each of said rollers extending beyond said housing bottom opening, said elongated rollers being provided with drive wheels; and E. means coupling said pulley drive wheel and said roller drive wheels together.

2. A massaging apparatus, according to claim 1, further including spring biasing means for biasing said rollers apart.

3. A massaging apparatus, according to claim 2, wherein one of said pair of elongated rollers is fixed in position and the other of said pair of rollers is movable in position with respect to said first roller.

4. A massaging apparatus, according to claim 1, further including screened opening means disposed opposite said hollow extending portion for permitting intake air to flow over said centrifugal squirrel cage fan.

5. A massaging apparatus, according to claim 1, wherein said auxiliary power means is a battery.

6. A massaging apparatus, according to claim 1, wherein said centrifugal squirrel cage fan is provided with small weights disposed about the circumference thereof to tend to maintain its rotation once powered.

7. A massaging apparatus comprising:

A. a hollow housing having;

a) a centrally disposed hollow chamber, b) an opening at the bottom, c) an outwardly extending handle means suitable for being held in a persons hand, disposed transverse to said opening, d) a hollow extending portion disposed proximate said outwardly extending handle means communicating with the hollow central chamber of said housing, said hollow extending portion adapted to be removably affixed to a vacuum generating source, e) control means for controlling the application of auxiliary power; and f) screened opening means disposed opposite said hollow extending portion for permitting intake air to flow therein;

B. auxiliary power means disposed within said hollow chamber coupled to said control means, said auxiliary power means being a battery;

C. flywheel motor means disposed within said hollow chamber coupled to said source of auxiliary power, said flywheel motor means having, a) an output shaft extending outwardly from said motor means transverse to said outwardly extending handle means, said output shaft having, i) a centrifugal squirrel cage fan disposed thereon at one end with small weights disposed about the circumference thereof to tend to maintain its rotation once powered, and ii) a pulley drive wheel disposed on the other end;

D. a pair of elongated rollers disposed parallel to said motor means shaft with a portion of each of said rollers extending beyond said housing bottom opening, said elongated rollers being provided with drive wheels and spring biasing means for biasing said rollers apart; and E. means coupling said pulley drive wheel and said roller drive wheels together.

8. A massaging apparatus according to claim 7, wherein one of said pair of elongated rollers is fixed in position and the other of said pair of rollers is movable in position with respect to said first roller.

* * * * *